US005619216A

United States Patent [19]

Park

[11] Patent Number: 5,619,216

[45] Date of Patent: Apr. 8, 1997

[54] DUAL POLARIZATION COMMON APERTURE ARRAY FORMED BY WAVEGUIDE-FED, PLANAR SLOT ARRAY AND LINEAR SHORT BACKFIRE ARRAY

[75] Inventor: Pyong K. Park, Agoura Hills, Calif.

[73] Assignee: Hughes Missile Systems Company, Los Angeles, Calif.

[21] Appl. No.: 469,831

[22] Filed: Jun. 6, 1995

[51] Int. Cl.[6] ..... H01Q 13/12

[52] U.S. Cl. ..... 343/771; 343/770; 333/137

[58] Field of Search ..... 343/770, 771, 343/767, 700 MS; 333/137, 248, 251

[56] References Cited

U.S. PATENT DOCUMENTS

| | | | |
|---|---|---|---|
| 3,599,216 | 8/1971 | Paine | 343/771 |
| 4,409,595 | 12/1983 | Park | 343/771 |
| 4,716,415 | 12/1987 | Kelly | 343/771 |
| 4,839,663 | 6/1989 | Kurtz | 343/770 |
| 5,172,127 | 12/1992 | Josefsson | 343/771 |
| 5,173,714 | 12/1992 | Arimura et al. | 343/771 |
| 5,270,724 | 12/1993 | Ajioka | 343/771 |
| 5,467,100 | 11/1995 | Chen | 343/770 |
| 5,543,810 | 8/1996 | Park | 343/771 |

*Primary Examiner*—Donald T. Hajec
*Assistant Examiner*—Tan Ho
*Attorney, Agent, or Firm*—Charles D. Brown; Wanda K. Denson-Low

[57] ABSTRACT

A common aperture dual polarization array that comprises a vertical polarization antenna array that provides for vertical polarization, and horizontal polarization antenna array that provides for horizontal polarization. The vertical polarization antenna array is comprised of a flat plate shunt slot standing wave array that includes a plurality of sets of radiating slots configured in a staggered pattern that are laterally separated by an air gap. The horizontal polarization antenna array is comprised of a collinear array of radiating slots, a strip reflector, and a plurality of baffles that form a short backfire antenna array. The collinear slots are disposed orthogonal to the radiating slots of the vertical polarization antenna array. A feed network is coupled to the vertical polarization and horizontal polarization antenna arrays that comprises a centered collinear standing wave array of longitudinally aligned feed slots coupled to the vertical polarization antenna array, and the collinear array of feed slots coupled to the horizontal polarization antenna array. The plurality of baffles may be disposed adjacent to the horizontal polarization antenna array for increasing the effective aperture thereof. The feed network may comprise an offset resonant iris disposed in a rectangular waveguide, or a boxed stripline that comprises a meandered stripline. The vertical polarization antenna array may further comprise a plurality of waveguide shorts disposed in the gap between the sets of radiating slots of the vertical polarization antenna array.

5 Claims, 4 Drawing Sheets

DUAL POLARIZATION COMMON APERTURE ARRAY FORMED BY WAVEGUIDE-FED, PLANAR SLOT ARRAY AND LINEAR SHORT BACKFIRE ARRAY

BACKGROUND

The present invention relates to antenna arrays, and more particularly, to a common aperture dual polarization array that employes a flat plate shunt slot standing wave array and a short backfire array that are fed by a centered collinear standing wave array.

Advanced seekers require high performance antennas for radiating electromagnetic energy containing horizontal and Vertical polarization components. There are a variety of dual-polarization seeker antenna arrays presently known upon which the present invention improves. These include a reflector antenna array employing a dual polarization feed. The reflector antenna array is bulky and its efficiency is low. Furthermore, it is very difficult to achieve low sidelobe array pattern in the reflector antenna array.

A second antenna array is a patch antenna array. The patch antenna array is low cost and low profile, but the bandwidth of each of its elements is extremely narrow. Therefore, producing a high performance antenna array using the patch element antennas is very difficult. Also, the efficiency of the patch antenna array is poor.

A third antenna array is a combination antenna array that is comprised of a shunt slot array fed by a rectangular waveguide that provides for vertical polarization, and a dipole array fed by a stripline that provides for horizontal polarization. This combination antenna array employs an efficient vertical polarization array, but the dipole array fed by the stripline is bulky. More particularly, control of the input impedance seen at the stripline of each dipole that is required to achieve a low sidelobe pattern is very difficult to achieve, and the overall input match of the array is also very difficult to achieve. The phase matching between the vertical polarization array and the horizontal polarization array is difficult because each array uses a different transmission line.

A fourth antenna array is a fully populated dual polarization standing wave array fed by a waveguide. This antenna array is described in copending U.S. patent application Ser. No. 08/470,528, filed Jun. 6, 1995 now U.S. Pat. No. 5,543,810, entitled "Common Aperture Dual Polarization Array Fed By Rectangular Waveguides", and is assigned to the assignee of the present invention. This antenna array is very complex for the case where the required gain of the horizontal polarization array is slightly greater than the gain of one quadrant of the main vertical polarization array. Such complexity results in a very costly and difficult to produce antenna array.

Consequently, it is an objective of the present invention to provide for a common aperture dual polarization array that improves upon the above-mentioned antenna arrays. It is a further objective of the present invention to provide for a common aperture dual polarization array that employs a flat plate shunt slot standing wave array and a short backfire antenna array that are fed by a centered collinear standing wave antenna array.

SUMMARY OF THE INVENTION

The present invention comprises a dual polarization (vertical polarization and horizontal polarization) common aperture array that employs efficient standing wave arrays. The main (vertical polarization) array is achieved by means of a longitudinal flat plate shunt slot standing wave array, and the horizontal polarization array is achieved using a short backfire antenna array fed by a standing wave array of centered collinear longitudinal slots. The short backfire antenna is comprised of a linear array of slots, a strip reflector, and a plurality of baffles.

More particularly, the common aperture dual polarization array comprises a vertical polarization antenna array comprising a flat plate shunt slot standing wave array that includes a plurality of sets of radiating slots configured in a staggered pattern and that are laterally separated by an air gap, and a horizontal polarization antenna array comprising a collinear array of centered longitudinal radiating slots that are disposed orthogonal to the radiating slots of the vertical polarization antenna array. A feed network is coupled to the vertical polarization and horizontal polarization antenna arrays that comprises a centered collinear standing wave array of longitudinally aligned feed slots coupled to the main vertical polarization antenna array, and a collinear array of feed slots coupled to the second auxiliary horizontal polarization antenna array.

The common aperture dual polarization array may further comprise a plurality of baffles disposed adjacent to the horizontal polarization antenna array that are adapted to increases the effective aperture thereof. The feed network may comprise an offset resonant iris disposed in a rectangular waveguide, or may comprise a boxed stripline that comprises a meandered stripline. The vertical polarization antenna array may further comprise a plurality of waveguide shorts disposed in the gap between the radiating slots of the main vertical polarization antenna array.

The present low profile common aperture dual polarization array fed by the standing wave array and has the following advantages compared to conventional arrays. The present dual-polarization antenna array is compact, has a low profile, and is highly efficient for both arrays. Phase matching between the vertical polarization and horizontal polarization arrays of the present dual polarization antenna array is simple because both arrays use the same kind of transmission line, namely a stripline. The main array (vertical polarization) produces a low sidelobe pattern and is relatively simple because it is easy to achieve a desired aperture distribution using the shunt slots fed by the rectangular waveguides. The baffle and the strip reflector may be designed so that the interference between them and the main (vertical polarization) array is minimized.

Current trends in RF seeker design emphasize the reduction of cost and volume while achieving high performance. The present common aperture dual polarization array provides a high performance and low profile dual polarization seeker antenna for use with medium to large-sized antenna arrays, and may be used in a variety of missile seekers.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1A:
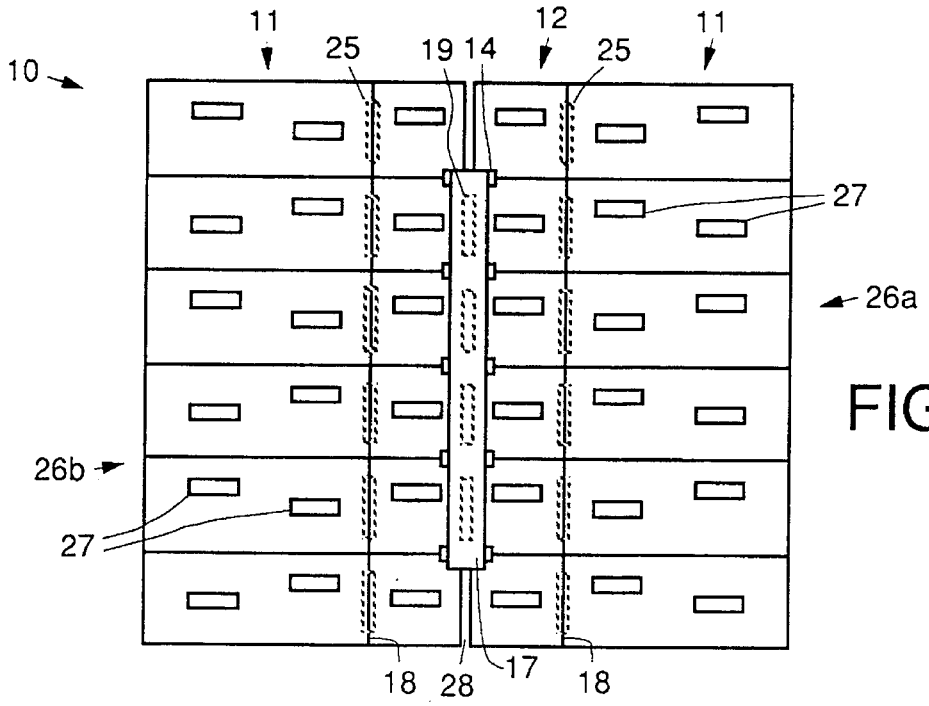
FIGS. 1*a*, 1*b* and 1*c* show top and cross sectional views of a common aperture dual polarization array in accordance with the principles of the present invention.
Figure 1B:
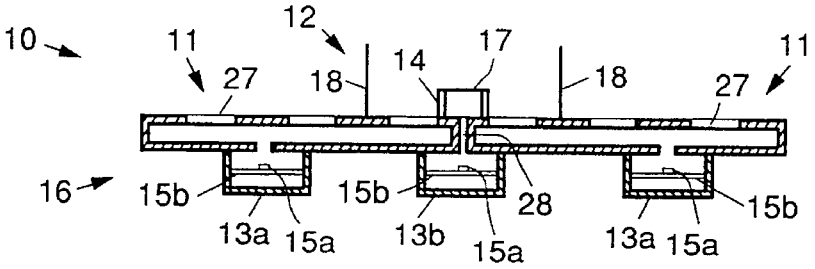
Figure 1C:
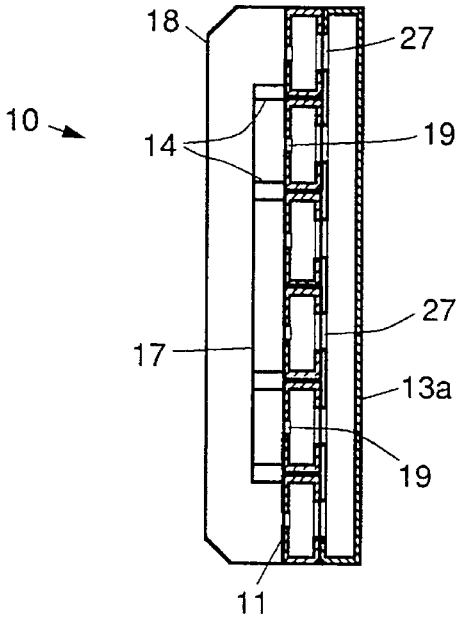

Referring to the drawing figures, FIGS. 1*a*, 1*b* and 1*c* show top and cross sectional views of a common aperture dual polarization array 10 in accordance with the principles of the present invention. The common aperture dual polarization array 10 comprises a main vertical polarization antenna array 11 and a second auxiliary horizontal polarization antenna array 12. The main vertical polarization antenna array 11 comprises a flat plate shunt slot standing wave array. The main vertical polarization antenna array 11 is comprised of a plurality of sets 26*a*, 26*b* of radiating slots 27 configured in a staggered pattern. The plurality of sets 26*a*, 26*b* of radiating slots 27 are separated by an air gap 28. The main vertical polarization antenna array 11 is fed by first and second vertical polarization antenna feed arrays 13*a* comprising two centered collinear standing wave feed arrays 13*a* that are part of a feed network 16. The two centered collinear standing wave feed arrays 13*a* may be provided by two air striplines 15*a* supported by dielectric substrate 15*b*.

The second auxiliary horizontal polarization antenna array 12 is a short backfire array 12 that includes a collinear array of radiating slots 19, a strip reflector 17, and two baffles 18. The strip reflector 17 is attached to the main vertical polarization antenna array 11 by means of a plurality of supports 14. The plurality of baffles 18 are symmetrically disposed a predetermined lateral distance away from longitudinal edges of the second auxiliary horizontal polarzation antenna array 12. The plurality of baffles 18 are disposed along a line formed by the plurality of feed slots 25 of the main vertical polarization antenna array 11 on the front side thereof adjacent the second auxiliary horizontal polarization antenna array 12. The second horizontal polarization antenna array 12 is fed by a horizontal polarization antenna feed 13b comprising a centered collinear standing wave feed array 13*b* that is part of the feed network 16. The centered collinear standing wave feed array 13*b* may be provided by an air stripline 15*a* supported by dielectric substrate 15*b*.

Figure 2:
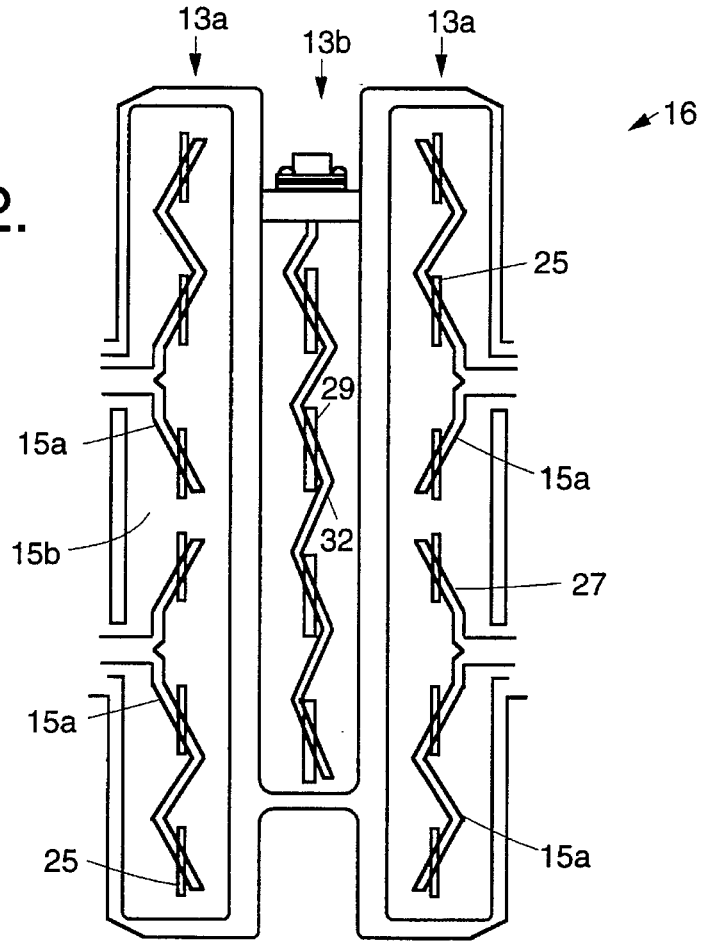
FIG. 2 is an illustration of a feed network employed in the common aperture dual polarization array of FIG. 1.

FIG. 2 is an illustration of the feed network 16 employed in the common aperture dual polarization array 10 of FIG. 1. The first and second vertical polarization antenna feed arrays 13*a* and the horizontal polarization antenna feed array 13*b* comprise the suspended air striplines 15*a*. The suspended air striplines 15*a* may be supported by a dielectric substrate 15*b*, such as duroid, for example. FIG. 2 shows that the respective feeds 13*a*, 13*b* comprise meandered boxed striplines. However, as will be discussed below with respect to FIGS. 5*a* and 5*b*, the feed 13*a* for the centered collinear standing wave array 13 may also comprise an offset resonant iris disposed in a rectangular waveguide. The feed network 16 forms the centered collinear standing wave array 13. The feed network 16 is comprised of a plurality of sets of longitudinally aligned feed slots 25 for the main vertical polarization antenna array 11 that are shown in phantom. Also, the collinear array of feed slots 29 for the second auxiliary horizontal polarization antenna array 12 is shown in phantom.

Figure 3:
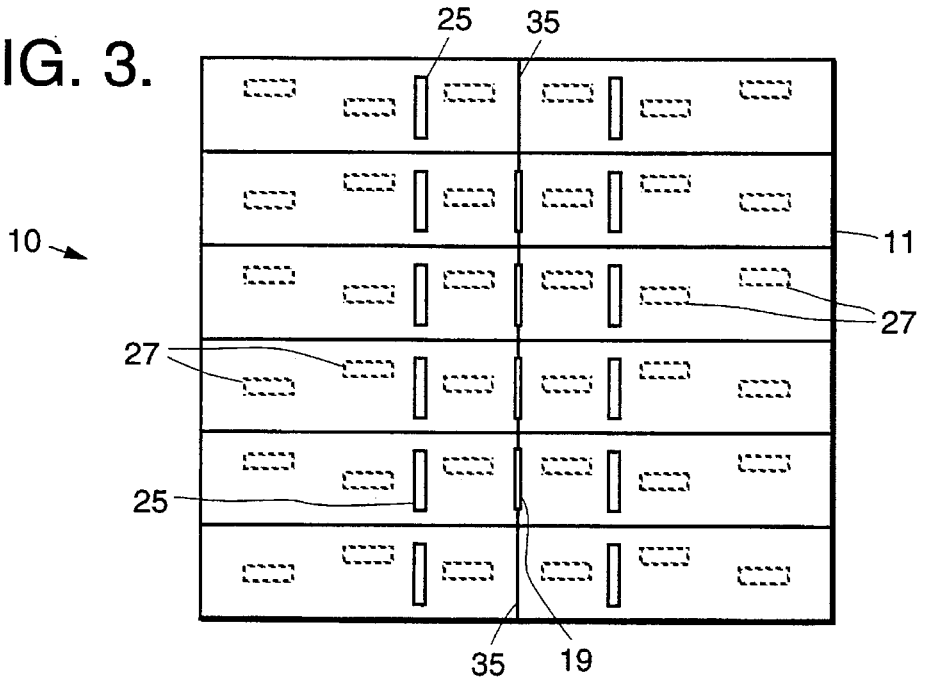
FIG. 3 illustrates a rear view of the common aperture dual polarization array of FIG. 1.

FIG. 3 illustrates a rear view of the of the common aperture dual polarization array 10 of FIG. 1. The feed slots 25 of the main vertical polarization antenna array 11 are shown, and the radiating slots 27 of the main vertical polarization antenna array 11 are shown in phantom. The radiating slots 19 of the second auxiliary horizontal polarization antenna array 12 are shown disposed along a centerline of the array 12. A plurality of shorts 35 are disposed between the sets 26*a*, 26*b* of radiating slots 27 of the main vertical polarization antenna array 11 in the gap 28 disposed therebetween.

Figure 4A:
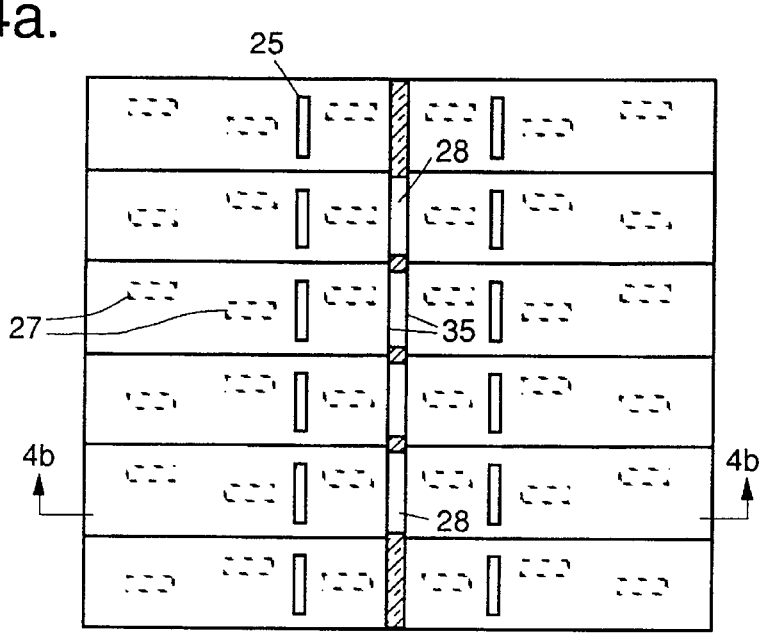
FIGS. 4*a* and 4*b* illustrate waveguide shorts disposed in a relatively long gap between sections of the main antenna array of the common aperture dual polarization array of FIG. 1.
Figure 4B:
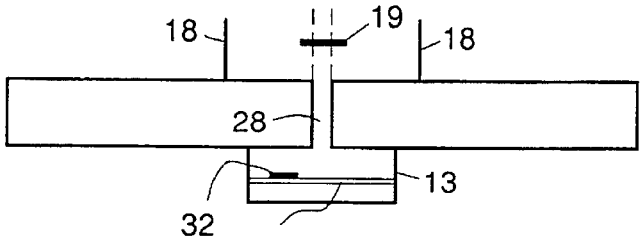

FIGS. 4*a* and 4*b* illustrate top and side views of the common aperture dual polarization array 10 of FIG. 1 which shows the waveguide shorts 35 disposed in the relatively long gap 28 between sections of the main vertical polarization antenna array 11. The use of the baffles 18 disposed adjacent the second auxiliary horizontal polarization antenna array 12 increases the effective aperture of the array 12.

Figure 5A:
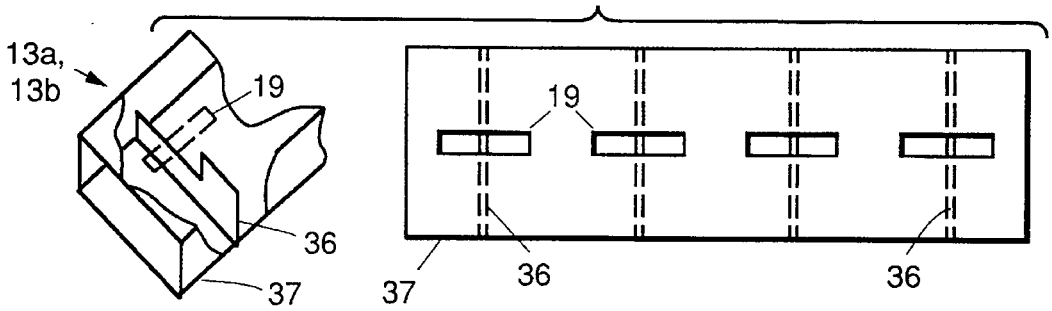
FIGS. 5*a* and 5*b* show two implementations of feed waveguides that may be employed in the common aperture dual polarization array of FIG. 1.
Figure 5B:
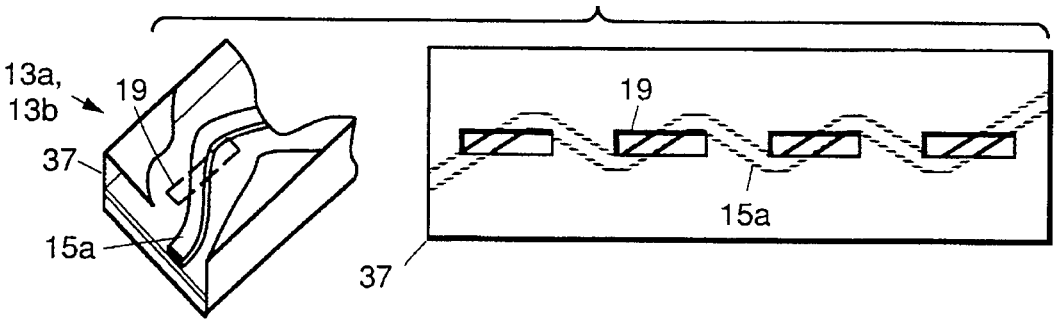
Figure 6A:
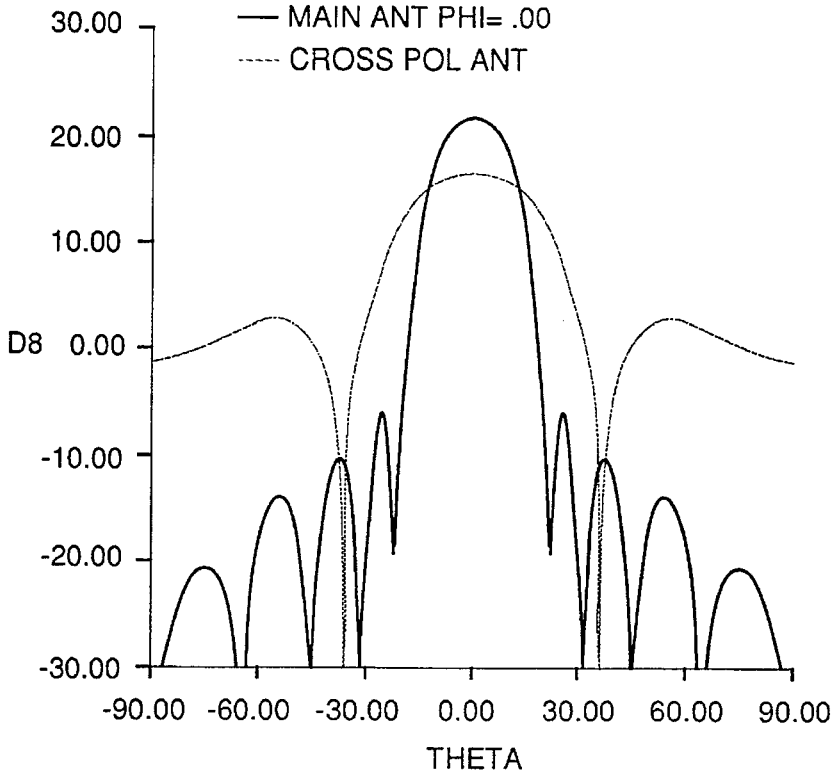
FIGS. 6*a* and 6*b* are graphs illustrating the performance of the common aperture dual polarization array of FIG. 1 having a five wavelength aperture.
Figure 6B:
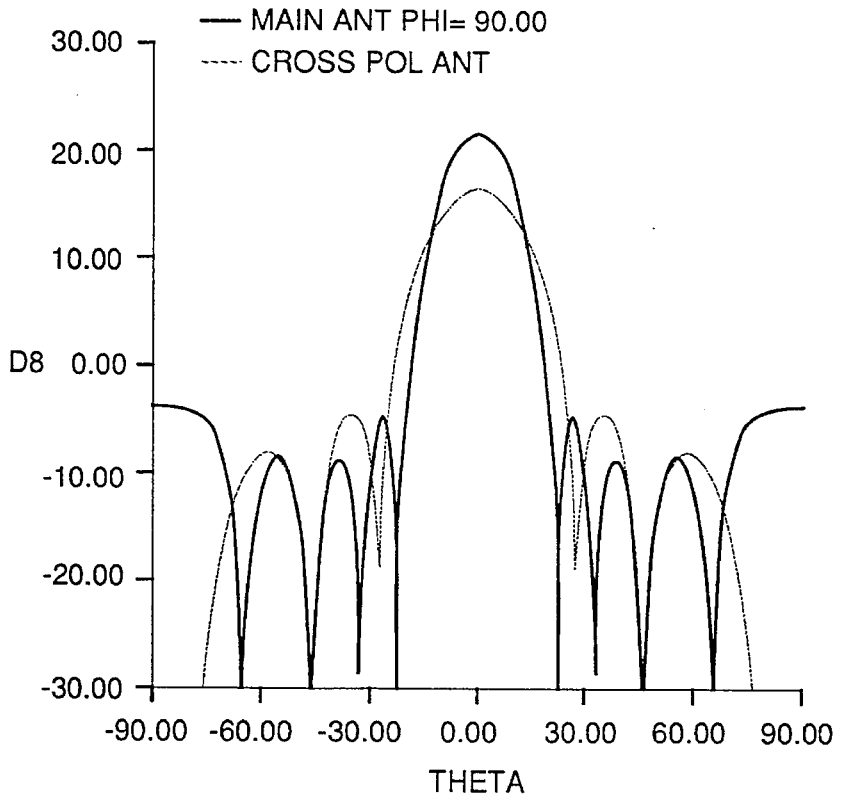

FIGS. 5*a* and 5*b* show two implementations of centered collinear standing wave feed arrays 13*a*, 13*b* that may be employed in the common aperture dual polarization array 10 of FIG. 1. With reference to FIG. 5*a*, it illustrates that the centered collinear standing wave feed array 13 may comprise an offset resonant iris 36 disposed in a rectangular waveguide 37. With reference to FIG. 5*b*, it illustrates that the centered collinear standing wave array 13*a*, 13*b* may comprise a boxed stripline that includes a meandered stripline 15*a* disposed in a rectangular waveguide 37.

In operation, the common aperture dual polarized array 10 of the present invention is such that its entire aperture is used for the main vertical polarization antenna array 11 and a part of the entire aperture is used for the horizontal polarization array 12. The main vertical polarization antenna array 11 is achieved using a highly efficient longitudinal shunt slot standing wave array of slots 19 fed by the rectangular waveguide 37, for example. The main vertical polarization array 12 has a natural wall in the middle thereof formed by the shorts 35 of the individual radiating sets 26*a*, 26*b* of slots 27 as shown in FIG. 2. The long gap in the middle of the main vertical polarization antenna array 11 is generated by moving the shorts 35 in the radiating sets 26*a*, 26*b* of slots 27, and the horizontal polarization array 12 is realized by the standing wave array of centered collinear longitudinal slots 25 as shown in FIG. 3.

The centered collinear longitudinal slots 25 may be fed by either the meandered boxed stripline 15*a* or an offset resonant iris 36 in the rectangular waveguide 37 as are shown in FIGS. 5*a* and 5*b*. The orthogonality of the polarization between the two antenna arrays 11, 12 is provided because the slots 27 that provide for vertical polarization and the slots 19 that provide for horizontal polarization are perpendicular to each other. However, the long collinear array of slots 19 that provide for horizontal polarization provides an undesirable fan beam antenna pattern.

The use of the short backfire array 13 fed by the collinear longitudinal slots 29 produces an acceptable round beam pattern instead of the undesirable fan beam pattern without disturbing the main vertical polarization antenna array 11. The short backfire array 13 effectively increases the aperture size of the collinear array 12 (horizontal polarization antenna array 12) to the square area inside of the baffles 18.

The energy radiated from the collinear array 12 is reflected by the narrow strip reflector 17 and fills up the area inside of the baffles 18. The narrow strip reflector 17 and the baffles 18 are designed using a metal strip of polarizer so that interaction between the short backfire array 13 and the main vertical polarization antenna array 11 is minimized.

A computer generated antenna pattern for vertical polarization and horizontal polarization beams for a five wavelength aperture is shown in FIGS. 5*a* and 5*b*. More particularly, FIGS. 5*a* and 5*b* show graphs illustrating the performance of the common aperture dual polarization array 10 of FIG. 1 having a five wavelength aperture.

Thus there has been described a new and improved common aperture dual polarization array that employes a fiat plate shunt slot standing wave array and a short backfire array that are fed by a centered collinear standing wave array. It is to be understood that the above-described embodiment is merely illustrative of some of the many specific embodiments which represent applications of the principles of the present invention. Clearly, numerous and other arrangements can be readily devised by those skilled in the art without departing from the scope of the invention.

What is claimed is:

1. A common aperture dual polarization array (10) comprising:

vertical polarization antenna army (11) comprising a flat plate shunt slot standing wave array that comprises a plurality of sets (26*a*, 26*b*) of radiating slots (27) configured in a staggered pattern and that are laterally separated by an air gap (28);

a horizontal polarization antenna array (12) comprising centered longitudinal radiating slots (19) that are disposed orthogonal to the radiating slots (27) of the vertical polarization antenna array (11), a strip reflector (17) and a plurality of baffles (18); and a feed network (16) coupled to the vertical polarization and horizontal polarization antenna arrays (11, 12) that comprises a centered collinear standing wave array of longitudinally aligned feed slots (25) coupled to the vertical polarization antenna array (11), and a collinear array of feed slots (29) coupled to the horizontal polarization antenna array (12).

2. The common aperture dual polarization array of claim 1 wherein the plurality of baffles are disposed adjacent to the horizontal polarization antenna array for increasing the effective aperture thereof.

3. The common aperture dual polarization array of claim 1 wherein the feed network comprises an offset resonant iris disposed in a rectangular waveguide.

4. The common aperture dual polarization array of claim 1 wherein the feed network comprises a boxed meandered stripline.

5. The common aperture dual polarization array of claim 1 wherein the vertical polarization antenna array further comprises a plurality of waveguide shorts disposed in the gap between the sets of radiating slots of the vertical polarization antenna array.

* * * * *